US005474395A

United States Patent [19]

Miki

[11] Patent Number: 5,474,395

[45] Date of Patent: Dec. 12, 1995

[54] SURFACE CONNECTOR FOR CONNECTING ADJACENT SURFACES OF TWO OBJECTS

[76] Inventor: Akira Miki, 940-17, Araku, Iruma-shi, Saitama-Ken, Japan

[21] Appl. No.: 234,570

[22] Filed: Apr. 28, 1994

[30] Foreign Application Priority Data

May 10, 1993 [JP] Japan ..... 5-029611 U
Dec. 17, 1993 [JP] Japan ..... 5-072782 U

[51] Int. Cl.[6] ..... E04F 21/26

[52] U.S. Cl. ..... 403/409.1; 403/405.1; 403/406.1; 248/235; 248/239; 248/250; 108/108; 108/158; 211/90

[58] Field of Search ..... 403/409.1, 405.1, 403/406.1; 248/250, 239, 222.4, 223.1, 235; 108/158, 157, 108; 211/90

[56] References Cited

U.S. PATENT DOCUMENTS 1,651,987 12/1927 Baker ..... 248/222.4 X
3,487,446 12/1969 Hero et al. ..... 248/222.4
3,687,410 8/1972 Holmgren ..... 248/235
4,871,136 10/1989 Bessinger et al. ..... 108/108 X

FOREIGN PATENT DOCUMENTS 2672480 8/1992 France ..... 248/250
743841 1/1956 United Kingdom ..... 248/250

*Primary Examiner*—Dave W. Arola
*Assistant Examiner*—Christopher J. Novosad
*Attorney, Agent, or Firm*—McGlew and Tuttle

[57] ABSTRACT

A connector which is convenient for use in connecting a cross board, a rod member to a vertical surface formed by a frame board, a wall. In a vertical section of the connector, in a longitudinal direction as an axial direction thereof, the connector is in the shape of a rectangle, a trapezoid, or a pentagon which is inclined on one side of an upper surface thereof. In a transverse direction, orthogonal to the longitudinal direction, the connector is formed generally in a wedge shape whose tip faces up. The bottom of the connector is in the shape of a trapezoid. A through-hole which permits insertion therein of a fixing member such as a screw or the like is formed in an axis portion extending in the longitudinal direction of the connector in a position eccentric to the axis portion. Further, transformed portions such as recesses or the like are formed in outer side faces extending in the longitudinal direction of the connector to constitute an anti-dislodgment structure between the transformed portions and other portions adjacent to the outer side faces.

8 Claims, 10 Drawing Sheets

SURFACE CONNECTOR FOR CONNECTING ADJACENT SURFACES OF TWO OBJECTS

FIELD OF THE INVENTION

The present invention relates in general to a surface connector for connecting adjacent surfaces of two objects when surfaces of the objects opposite the adjacent surface are not substantially accessible. In particular the present invention relates to a connector for use in connecting a cross board, a rod member, to a vertical surface formed by a frame boards, a wall.

BACKGROUND OF THE INVENTION

Among the wardrobes, bookshelves and the like available in recent years there are included assembly type ones which are provided in a so-called knockdown fashion for being assembled by the user. In such an assembly type bookshelf or the like, screws as so-called connectors are used for connecting shelf boards disposed in the lateral direction to frame boards disposed in the vertical direction.

More particularly, as shown in FIG. 22, screws 2 are threaded into a cross board 3, used as a shelf board, from the outsides of frame boards 1 which form vertical surfaces the screws are inserted through holes 1*a* formed beforehand in the frame boards 1 and then through end faces of the cross board.

However, such method of connecting the cross board 3 to the frame boards 1 by using the screws 2 can be applied to the case where two frame boards 1 are present right and left and cannot be applied to the case where three or more frame boards 1 are arranged in parallel.

In other words, as to relatively large-sized bookshelves and the like including three or more frame boards 1 arranged in parallel, it is impossible to provide them in a knockdown fashion.

On the other hand, in houses of recent years, bookshelves and the like are often provided as built-in structures in which they are buried in walls. But in case of post-mounting of such built-in type bookshelves or the like and in case of connecting the cross board 3 to the frame boards 1 which form vertical surfaces, there is adopted a so-called nailing method which uses nails 4 as connectors for connecting the cross board 3 to the frame boards 1.

Such nailing method is applicable also to the case where three or more frame boards 1 are arranged in parallel and cross boards 3 are disposed between. adjacent frame boards.

In this case, however, since the nails 4 are driven in obliquely from the lower surface side of each cross board 3. Disadvantages are caused such that the nailing work is not easy and it is difficult to ensure against disengagement of the cross board 3 from the frame boards, namely durability.

In view of the above point, in the case of using the nails 4, a metallic support piece 5 can be disposed between the underside of each cross board 3 and the inside face of each frame board 1, as indicated with phantom lines in FIG. 23. Also a groove 1*b* can be formed in the inside face of each frame board 1, and an end portion of the cross board 3 is inserted into the groove 1*b*, as indicated also with phantom lines in the same figure.

However, in the above method using the metallic support pieces 5 or the grooves 1*b*, an increase in the number of working steps results. In recent years, the cost required for the execution of this type of operations has been increasing, and the large cost for obtaining a desired bookshelf or the like is inconvenient.

Besides, the nailing method referred to above is not applicable to the foregoing knockdown system and therefore a large-sized bookshelf or the like cannot be provided according to the knockdown system.

For example, in providing a stair handrail structure by a post-mounting method and for connecting an end portion of a bar member which forms the handrail to a vertical surface such as a wall or the like, as shown in FIG. 24, there has heretofore been no other method than the nailing method. In this method an end face of the handrail 7 is held as a bar member held in an abutted state against a wall 6 which forms a vertical surface. Nails 4 are driven in from the lower surface side of the handrail in the same manner as mentioned previously.

Also in this case, with nailing alone, the durability is not very reliable. Therefore it is necessary to separately use auxiliary metal fittings (not shown), so that a large cost is required for obtaining a desired stair handrail structure as in the foregoing case.

SUMMARY AND OBJECTS OF THE INVENTION

The present invention has been accomplished in view of the above-mentioned circumstances and it is the object of the invention to provide a connector which is convenient in connecting a cross board, a rod member or the like to a vertical surface or the like formed by a frame board, a wall or the like.

In order to achieve the above-mentioned object, the connector according to the present invention is characterized in that a vertical sectional shape thereof in a longitudinal direction as an axial direction is a rectangle, a trapezoid, or a pentagon whose upper surface is inclined on one side. A vertical sectional shape of the connector in a transverse direction orthogonal to the longitudinal direction is generally wedge-like with a tip end facing upward and a trapezoidal bottom. A through-hole which permits insertion therethrough of a fixing member such as a screw or the like is formed in an axis portion extending in the longitudinal direction or in a position eccentric to the said axis portion. Outer side faces of the connector extending in the longitudinal direction are provided with transformed portions such as recesses or the like which constitute an anti-dislodgment structure between them and other portions adjacent thereto.

Preferably, a tenon-like insert portion or means is formed integrally with an end face on the front end side where one end of the through-hole opens. The through-hole is formed centrally in the tenon-like insert portion or in a position eccentric to the central portion. A slit is formed on the tip end side of a generally wedge shape whose tip faces upward, and another member, e.g. tap screw, is press-fitted into the slit whereby the tip end side of the generally wedge shape can be opened or swelled.

According to the connector of the above construction, its front end as one end or contact side thereof is held in a position adjacent to a frame board or the like which forms a vertical surface. In this state a screw as a fixing member is inserted into the through-hole of the connector and is threaded into the frame board or the like with a screw-driver as a tool. The connector is thus fixedly connected to the frame board or the like.

In this case, the connector is positioned so that its tip end side faces upward.

For further ensuring the connected state of the connector to the frame board or the like, a tenon-like insert portion is formed integrally with the front end face as one end face of the connector. The insert portion is fitted, for example, in a circular hole formed in the frame board or the like.

By forming the tenon-like insert portion in a shape difficult to swivel and other than the cylindrical shape, the rotation of the connector itself is prevented upon insertion of the insert portion into a hole or the like opposed thereto.

In this connection, when the through-hole of the connector is formed in the axis portion extending longitudinally of the connector, the through-hole opens centrally of the insert portion in principle. While when the through-hole is formed in a position eccentric to the axis portion, one end thereof opens in a position eccentric to the center of the insert portion.

Therefore, in the case where such connectors with one end of the through-hole opening in a position eccentric to the center of the insert portion are connected to both side faces of a frame board or the like, the respective screws as fixing members can dodge each other.

By bringing down a cross board, or the like, from above the connector positioned adjacent a frame board or the like and burying the connector into a recess preformed in the underside of the cross board or the like, it is made possible to connect both boards.

Since the recess has a shape conforming to the shape of the connector and the connector is formed from polypropylene which is a relatively hard plastic material, there is not required any extremely large external force for burying the connector into the recess.

Moreover, once the connector is buried into the recess formed in the underside of a cross board or the like, it can no longer be disengaged from the recess under the action of an ordinary external force because of an anti-dislodgment structure present between the connector and the recess.

Further, the tip end side of the connector formed in a generally wedge-like shape has a slit, and when the slit is opened with a tap screw inserted therein from the bottom side of the connector, the tip side of the wedge-like connector is opened or swelled, whereby the dislodgment of the connector from the recess of the cross board or the like is prevented continuously.

Upon removal of the tap screw, the opened or swelled state of the tip side of the wedge-like connector is released, so that the connector can be pulled out from the recess, that is, the separation of the cross board from the frame board or the like can be effected.

DETAILED DESCRIPTION OF THE PREFERRED EMBODIMENTS

Figure 1:
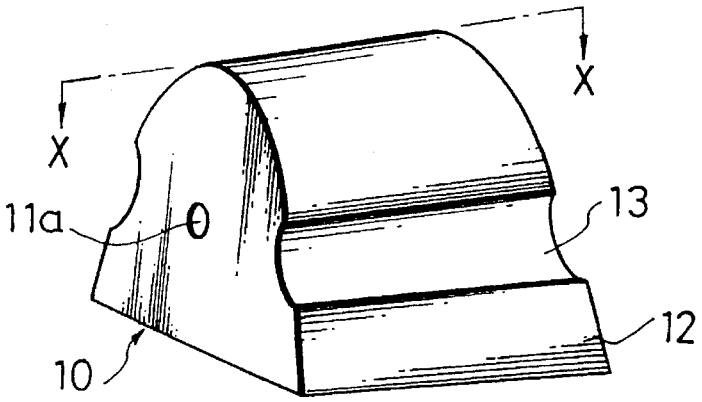
FIG. 1 is a perspective view of a connector according to an embodiment of the present invention.
Figure 2:
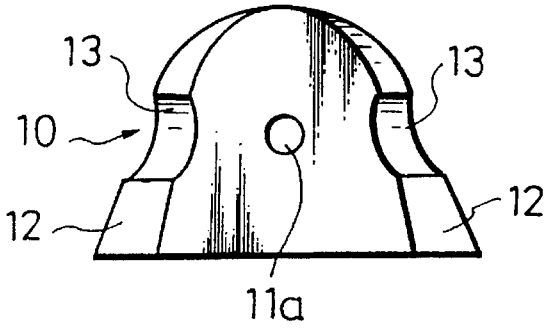
FIG. 2 is a side view of a front end side of the connector.
Figure 3:
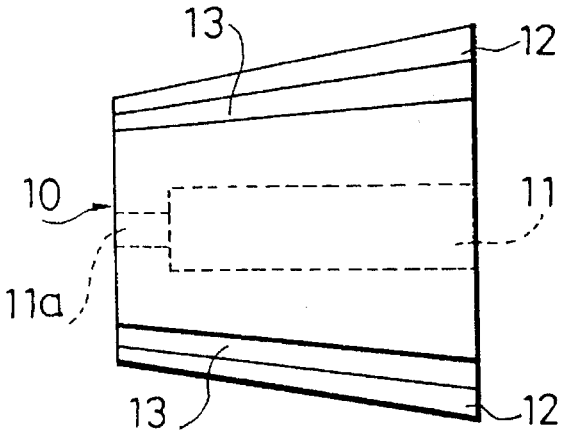
FIG. 3 is a plan view of the connector shown in FIG. 1.
Figure 4:
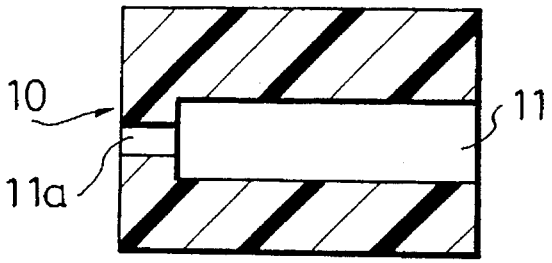
FIG. 4 is a vertical sectional view of the connector shown in FIG. 1.

The present invention will be described in detail hereinunder on the basis of the embodiments illustrated in the drawings. In a connector 10 according to an embodiment of the present invention has a contact side portionable adjacent the surface of the first object to be connected. A vertical sectional shape of the connector in a longitudinal direction, as an axial direction thereof, is rectangular (see FIG. 4). A vertical sectional shape of the connector 10 in a transverse direction orthogonal to the longitudinal direction is generally wedge-like with its tip side facing up (see FIG. 2) and a bottom shape or base side thereof is trapezoidal (see FIG. 3).

Although in the illustrated embodiment the connector 10 is formed from a relatively rigid plastic material, e.g. polypropylene, it may be formed using aluminum or the like. Also as to a molding method for the connector, there may be adopted any suitable method, e.g. cutting, or monolithic molding which us is a mold.

The connector 10 has a through-hole 11 which permits insertion therein of a screw (see FIG. 7) as a fixing member, the through-hole 11 being formed in a substantially axis portion in the longitudinal direction, and also has transformed portions 13 which are recesses, the transformed portions 13 being formed at outer side faces 12 extending in the longitudinal direction to constitute an anti-dislodgment structure or means between them and other portions adjacent to the outer side faces 12.

The through-hole 11 as a whole is formed in a large diameter so as to permit insertion therein of the head portion of the screw 2, but on a front end side (the leftmost end in FIGS. 3 and 4) of the connector 10 the through-hole 11 has a reduced-diameter portion 11*a* for insertion therein of only the body portion of the screw 2. The reduced-diameter portion 11*a* is open in the front end face of the connector 10.

Although in the illustrated embodiment the transformed portions 13 are formed as partially recessed portions of the outer side faces 12, they may be formed as partially raised portions of the outer side faces.

The connector 10 thus constructed is used for connecting a cross board, a rod member or the like to a vertical surface or the like formed by a frame board, wall or the like. In using the connector 10, a predetermined machining is applied to a cross board or the like to be connected to a frame board or the like.

Figure 5:
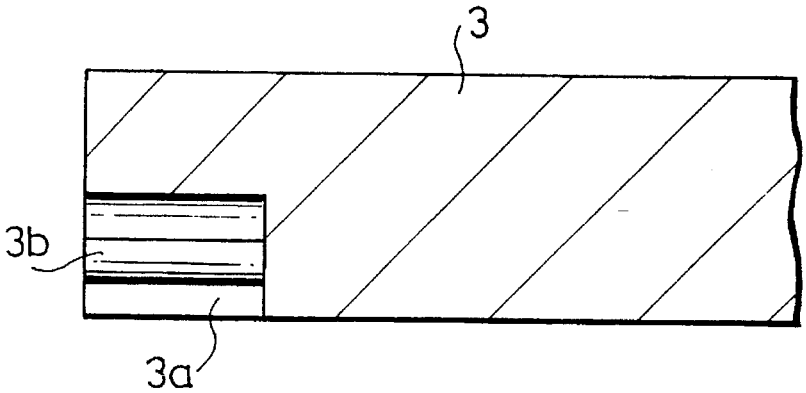
FIG. 5 is a partial vertical sectional view of a cross board having a recess for burying therein the connector shown in FIG. 1.
Figure 6:
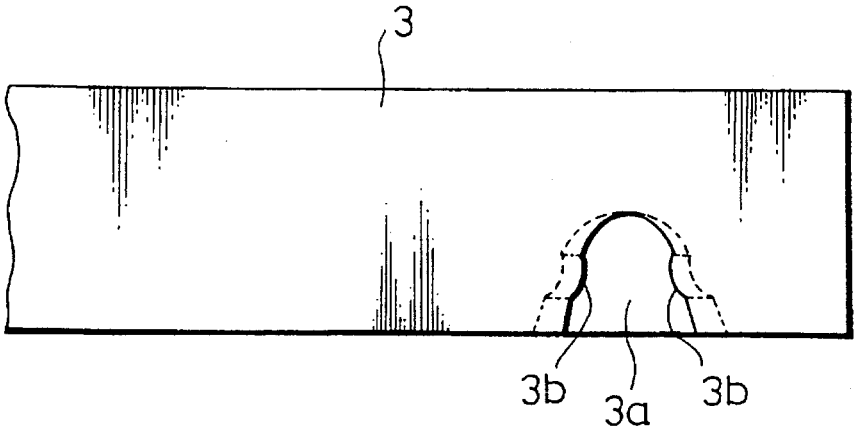
FIG. 6 is a partial side view of the cross board with recess shown in FIG. 5.

More specifically, as shown in FIGS. 5 and 6, in the case of a cross board 3 to be connected to a frame board 1 (see FIG. 7) which forms a vertical surface, a recess 3*a* conforming approximately to the shape of the connector 10 is formed in the underside of the cross board 3.

In the case where the cross board 3 is used as a shelf board of a bookshelf or the like, the recess 3*a* is formed in four positions of the cross board which are front, rear, right and left positions. It goes without saying that the number of the recess 3*a* to be formed depends on in what condition the connector is used. For example, in the case where an end portion of a bar member which constitutes a handrail of a stair handrail structure is to be connected to a vertical surface such as a wall or the like, the recess 3*a* is formed at one position in the lower surface of the said end portion of the bar member.

Preferably, the recess 3*a* is formed so that when the connector 10 is buried in the recess 31, its bottom is exposed to the underside of the cross board 3 while it is at the same level as the cross board underside.

In this embodiment the recess 3*a* has protuberances 3*b* formed on its inner peripheral surface, the protuberances 3*b* being fitted in the recesses 13 formed in the outer side faces 12 of the connector 10.

Figure 7:
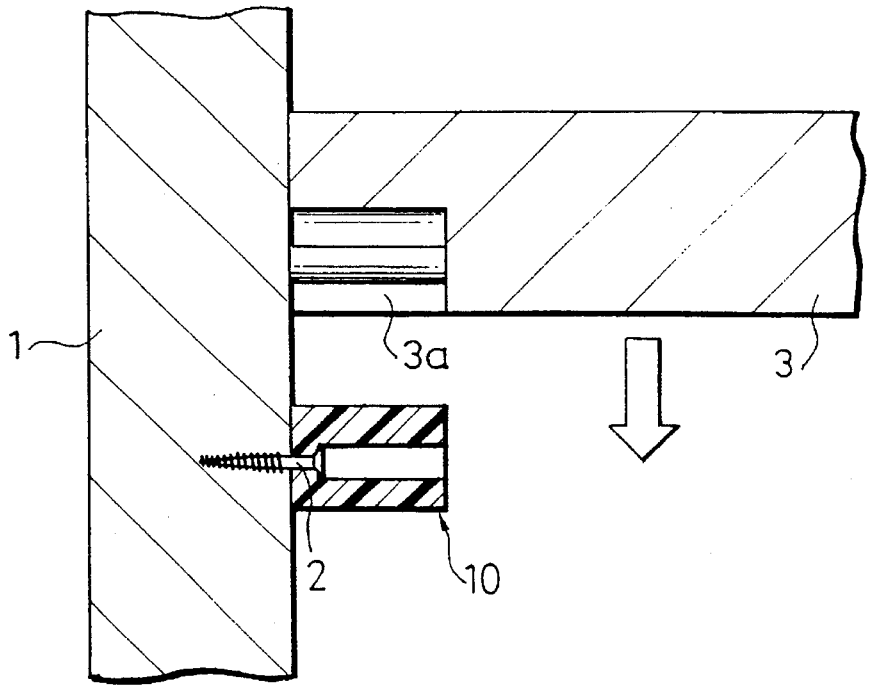
FIG. 7 is a partial vertical sectional view illustrating a mounted state of the connector shown in FIG. 1 to a frame board.

On the other hand, as shown in FIG. 7, one end of the connector 10, namely its end face in which the reduced-diameter portion 11*a* is opened to permit projection therefrom of the front threaded portion of the screw 2 as a fixing member, is brought into contact with the opposed vertical surface formed by the frame board 1. At the same time the screw 2 which is inserted into the through-hole 11 is further threaded in with a screw-driver as a tool. The connector 10 is thus fixed to the frame board 1.

At this time, as a matter of course, the connector 10 should be mounted so that its tip side faces upward.

Figure 8:
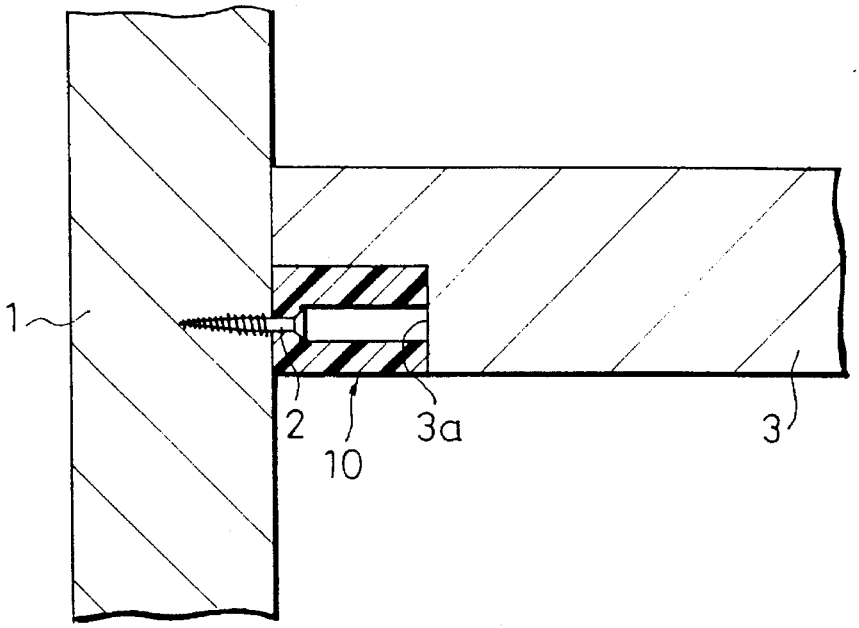
FIG. 8 is a partial vertical sectional view showing a connected state of the cross board to the frame board by using the connector of FIG. 1 attached to the frame board.
Figure 9:
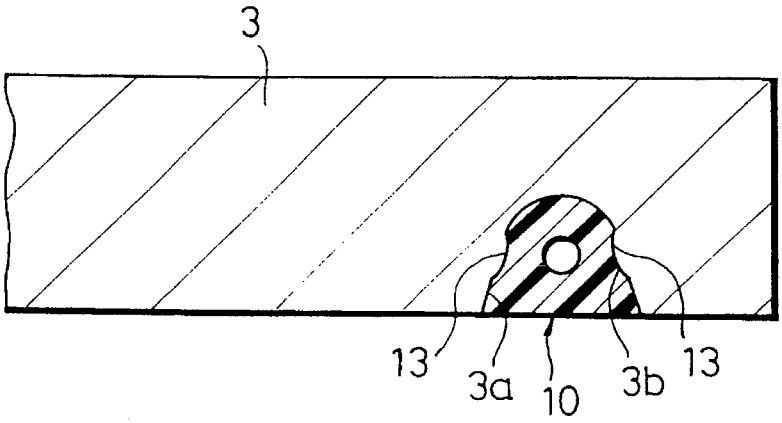
FIG. 9 is a partial vertical sectional view showing a connected state of the cross board to the frame board by using the connector of FIG. 1 attached to the frame board.

In this state, the cross board located above the connector 10 is moved in the direction of arrow in FIG. 7, namely downward, until the connector 10 is completely fitted in the recess 3*a* of the cross board, as shown in FIGS. 8 and 9.

In this case, since the recess 3*a* is formed in a shape conforming to the shape of the connector 10, a large external force is required for fitting the connector into the recess 3*a*. However, in the case where the cross board 3 is a wooden board for example, the connection of the two can be done relatively easily, that is, without requiring an extremely large external force, because the connector 10 is formed from polypropylene which is a relatively rigid plastic material.

As a result, in connecting the connector 10 and the cross board 3 with each other, an anti-dislodgment structure is constituted between the connector and the recess 3*a* by both the recesses as the transformed portions 13 and the protuberances 3*b* mating with the recesses, whereby an integral connection of the two is realized.

Figure 10:
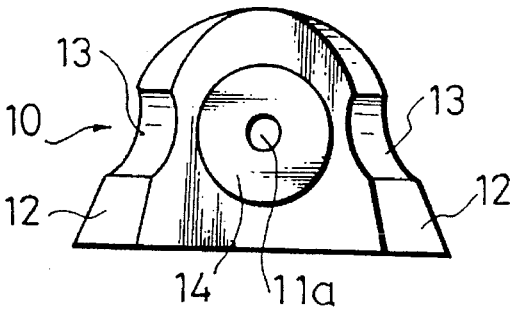
FIG. 10 is a side view of a front end side of a connector according to another embodiment of the present invention.
Figure 11:
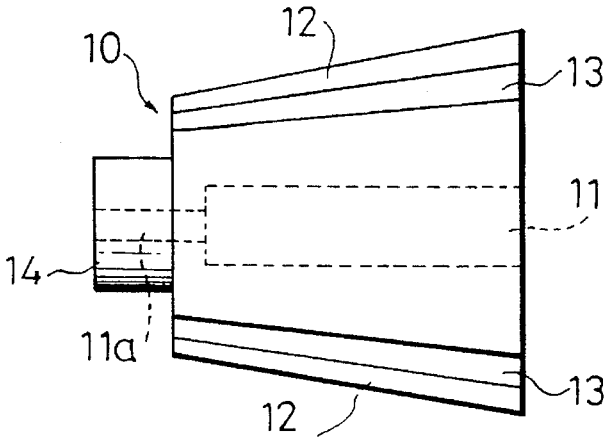
FIG. 11 is a plan view of the connector shown in FIG. 10.

In this way the connector 10 permits connection of the cross board 3, a rod member, or the like to a vertical surface, or the like formed by the frame board 1, a wall or the like. To further ensure the connected state of the connector 10 to the frame board 1 or the like, it is preferable that a cylindrical tenon-like insert portion 14 be formed integrally with the end face of the connector in which the reduced-diameter portion 11*a* of the through-hole 11 is opened, as shown in FIGS. 10 and 11.

In this case, a hole having a circular section for insertion therein of the insert portion 14 is formed beforehand on the frame board 1 side, and thus the mounting position of the connector 10 is indicated beforehand on the frame board 1 side. This is advantageous in that such inconvenience as misunderstanding the mounting position of the connector 10 is eliminated in advance.

The connector 10 constructed as in the above embodiment may undergo the following modifications.

Figure 12:
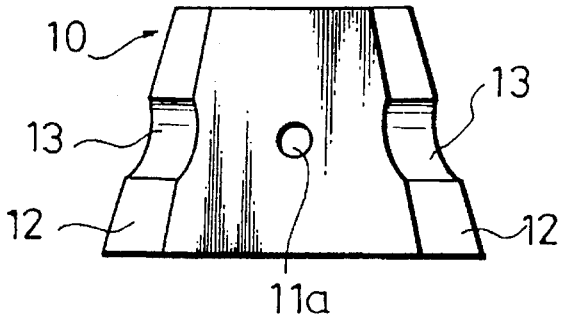
FIG. 12 is a side view of a front end side of a connector according to a further embodiment of the present invention.

First, as shown in FIG. 12, the wedge shape of the connector 10 in the above embodiment may be changed into a wedge shape similar to a trapezoid not having a roundish tip.

Figure 13:
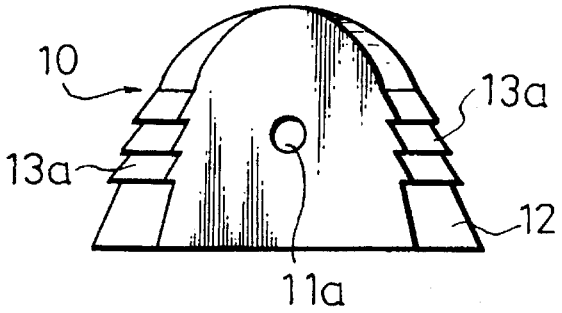
FIG. 13 is a side view of a front end side of a connector according to a still further embodiment of the invention.
Figure 14:
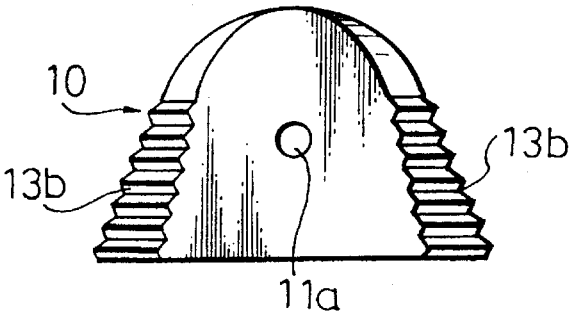
FIG. 14 is a side view of a front end side of a connector according to a still further embodiment of the invention.

Next, as to the transformed portions 13 formed as recesses may be substituted by such transformed portions 13*a* comprising interlocked teeth as shown in FIG. 13, or such transformed portions 13*b* comprising angular wave-like small projections as shown in FIG. 14.

The adoption of the transformed portions 13*a* or 13*b* is advantageous in that it is not required to form the protuberances 3*b* (see FIGS. 5 and 6) in the recess 3*a* which is formed beforehand in the underside of the cross board 3.

Figure 15:
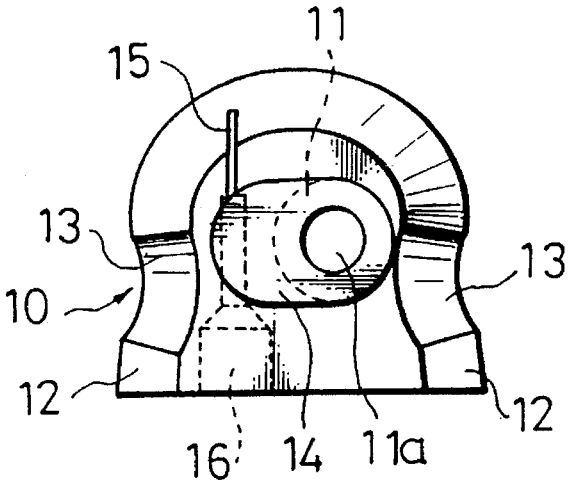
FIG. 15 is a side view of a front end side of a connector according to a still further embodiment of the invention.
Figure 16:
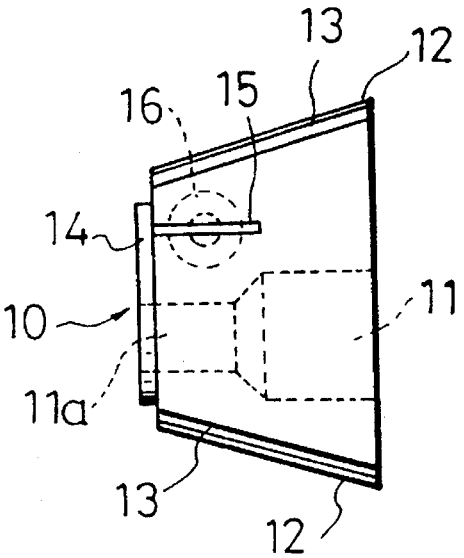
FIG. 16 is a plan view of the connector shown in FIG. 15.

Referring now to FIGS. 15 and 16, there is illustrated a connector 10 which is constructed so as to permit rater separation of the cross board 3 (see FIG. 8) from the frame board 1 (see FIG. 8) to which the cross board has been connected.

Other constructional points are the same as in the previous embodiments, and are indicated by the same reference numerals as in the previous embodiments. Detailed explanations thereof will be omitted.

According to the construction of the connector 10 in this embodiment, as shown in FIG. 15, the connector is formed in the shape of a wedge having gentle slopes when viewed from its front end side so as to permit easy removal thereof in principle. The tip side of the wedge shape corresponds to the upper end in FIG. 15 and can be forced to open.

More specifically, the connector 10 has a slit 15 on its front end side which is the left-hand side in FIG. 16. The slit 15 extends in the axial direction of the connector, and also has a screw insertion hole 16 formed in the bottom of the connector. The screw insertion hole 16 extending vertically through the connector and communicating at its upper end with the slit 15.

Also in this embodiment, transformed portions 13 as recesses are formed in the outer side faces 12 of the connector to constitute an anti-dislodgment structure between them and other portions adjacent to the outer side faces.

In this embodiment, though not shown, the connector 10 is formed in a trapezoidal shape having an inclined upper side in its vertical section in the longitudinal direction thereof.

Figure 17:
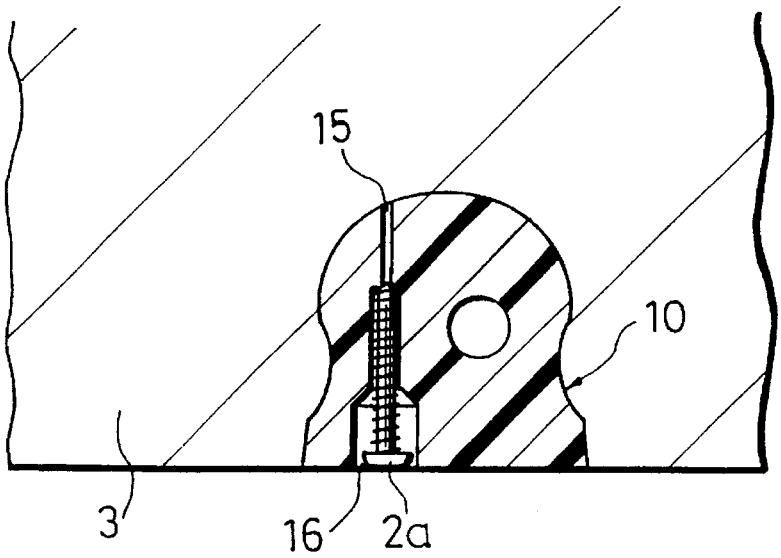
FIG. 17 is a partial vertical sectional view illustrating a mounted state of the connector shown in FIG. 15 to a frame board.
Figure 18:
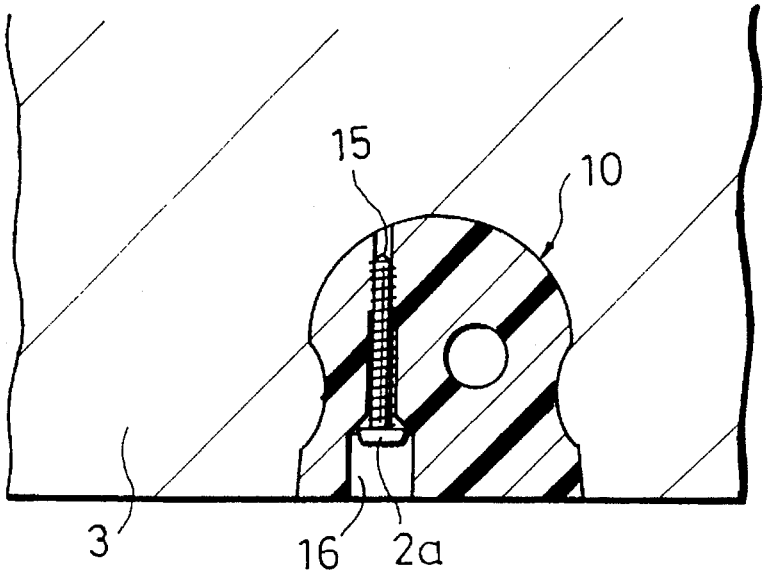
FIG. 18 is a partial vertical sectional view similar to FIG. 17, illustrating an opened state of a tip side of the connector of FIG. 15 attached to the frame board.

Into the screw insertion hole 16 is inserted a tap screw 2*a*, as shown in FIGS. 17 and 18. When the tap screw 2*a* is inserted shallowly as in FIG. 17, its tip side does not reach the slit 15 and hence the tip side of the wedge shape does not open.

On the other hand, when the tap screw 2*a* is inserted deep and its tip side reaches the interior of the slit 15, the slit is forced to open, so that the tip side of the wedge shape is opened.

Consequently, when the connector 10 is connected to a cross board 3 or the like and the tap screw 2*a* is inserted deep into the screw insertion hole 16, the dislodgment or separation of the connector 10 from the crossboard 3 or the like is prevented. According to this embodiment, therefore, a fixed connection between a frame board or the like and the cross board 3 or the like can be attained through the connector 10, while it becomes possible to separate the cross board 3 or the like from the frame board 1 side upon removal of the tap screw 2*a*.

The connector 10 of this embodiment has an insert portion 14 formed integrally with its front end face. Although the insert portion 14 in the embodiment illustrated in FIG. 10 is formed in the shape of a column, the insert portion 14 in this embodiment is formed in a cylindrical shape having an elliptical section. The reduced diameter portion 11*a* of the through-hole 11 is open in an eccentric position of the insert portion.

On the side of the frame board 1, or the like, to which the connector 10 of this embodiment is connected, there is formed a hole of a shape mating with the shape of the insert portion 14 in a position corresponding to the insert portion, though not shown.

Unlike the previous embodiments, the through-hole 11 is formed in a position eccentric to the axis portion of the connector.

When the connector 10 is connected to the frame board 1 or the like with screw 2 (see FIG. 7) as a fixing member, the rotation of the connector itself is prevented by both the insert portion 14 of an elliptic section and the hole into which the insert portion is inserted. Thus, the fixing of the connector in an upright state to the frame board 1 or the like can be realized easily.

In this embodiment, moreover, when such connectors 10 are disposed in a coaxially opposed relation to each other on both sides of the frame board 1, the screws as the respective fixing members dodge each other and thus the intercollision of the two is avoided.

Figure 19:
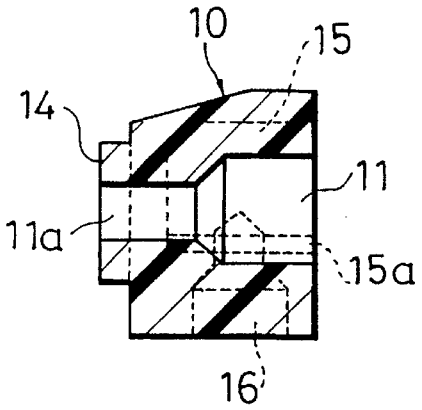
FIG. 19 is a vertical sectional view of a connector according to a still further embodiment of the invention.
Figure 20:
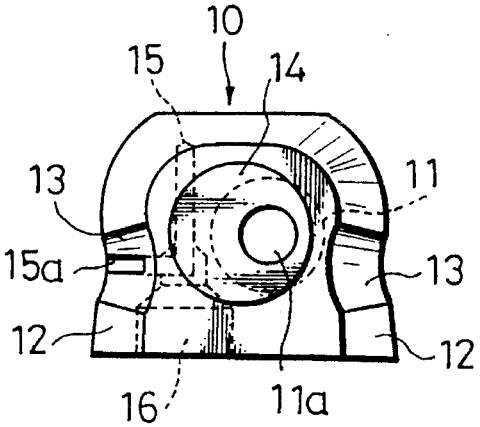
FIG. 20 is a side view of a front end side of the connector shown in FIG. 19.
Figure 21:
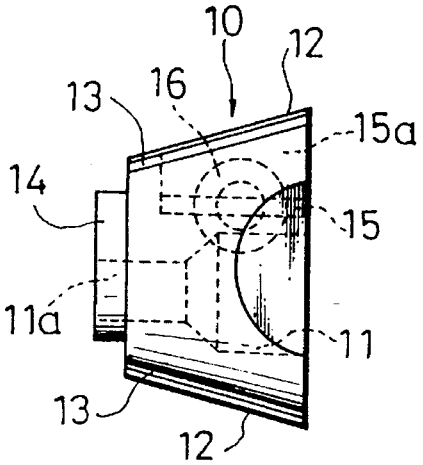
FIG. 21 is a plan view of the connector shown in FIG. 19.
Figure 22:
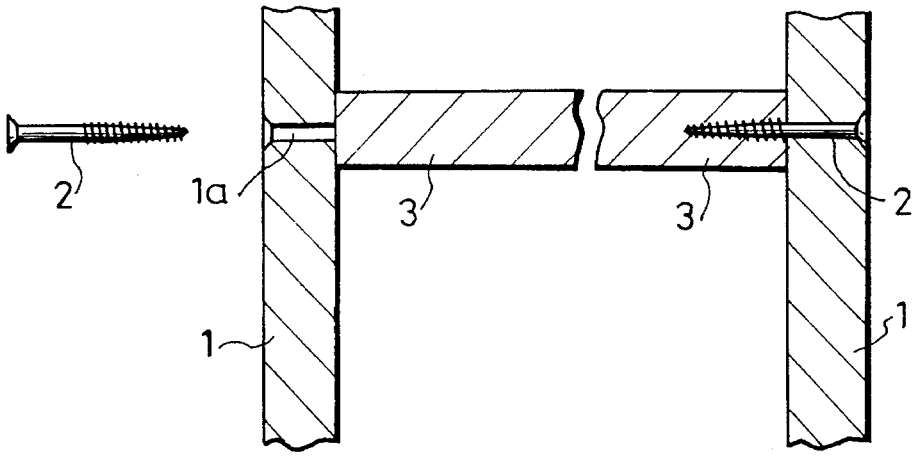
Fig.22 PRIOR ART
FIG. 22 is a partial vertical sectional view showing a connected state of frame boards and a cross board according to a conventional example.
Figure 23:
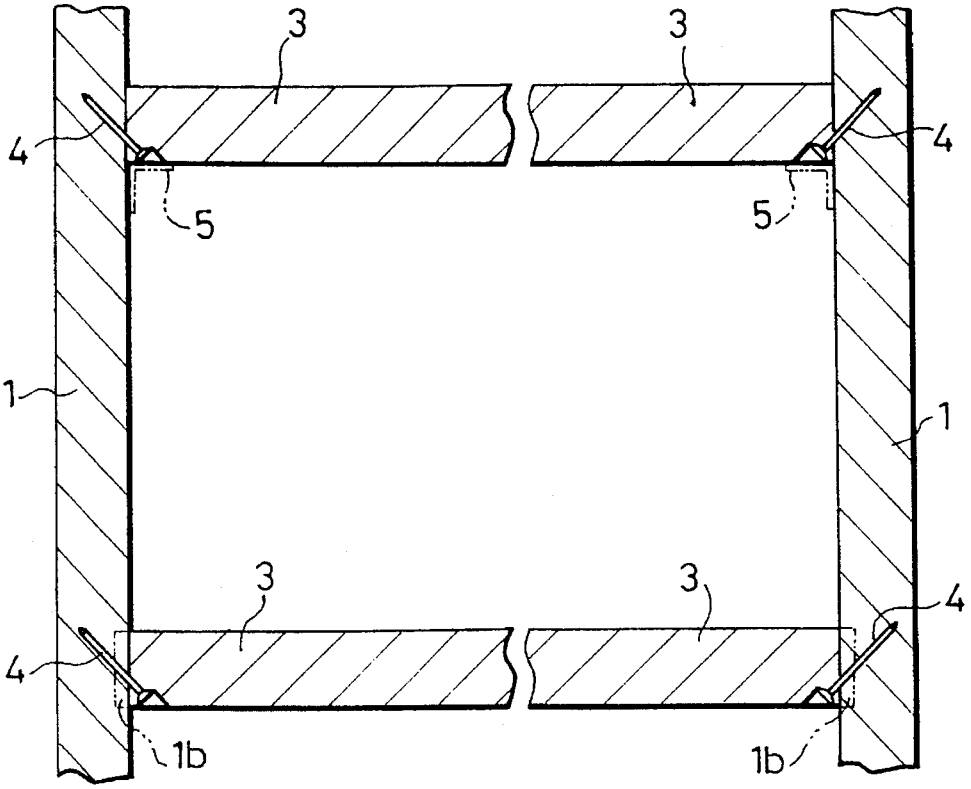
Fig.23 PRIOR ART
FIG. 23 is a partial vertical sectional view showing frame boards cross board connected states according to conventional examples.
Figure 24:
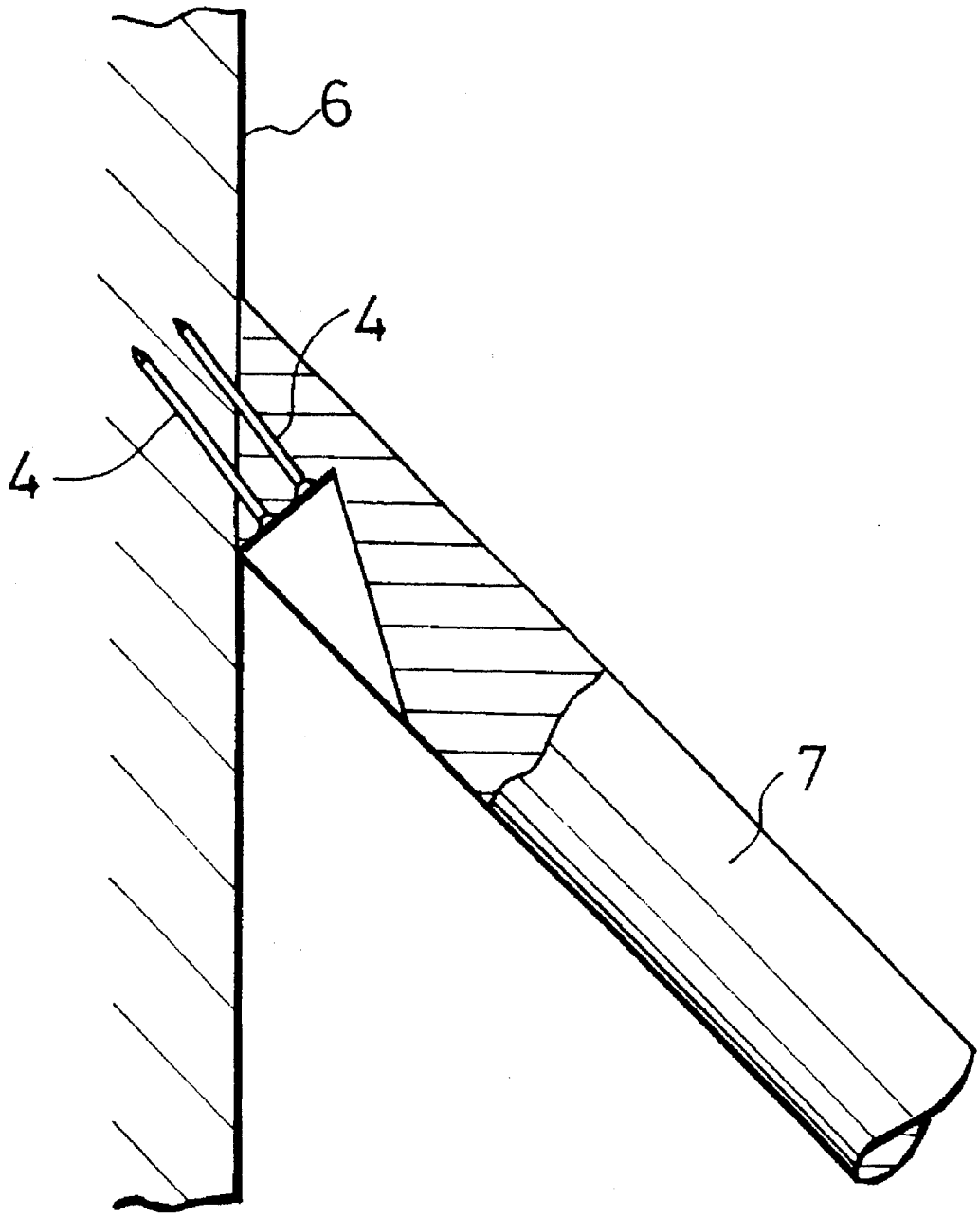
Fig. 24 PRIOR ART
FIG. 24 is a partial vertical sectional view showing a wall—handrail connected state according to a conventional example.

FIGS. 19 to 21 illustrate a connector 10 according to a further embodiment of the present invention in which the following modification is made with respect to the connector 10 shown in FIGS. 15 and 16.

Other constructional points are the same as in the preceding embodiment, and so are indicated by the same reference numerals as in the preceding embodiment. Detailed explanations thereof will be omitted.

In a vertical section in a longitudinal direction as an axial direction, which is the right and left direction in FIG. 19, the connector 10 of this embodiment is in the shape of a pentagon whose upper surface or tip side is inclined on one side. One of the surfaces on the tip side is inclined with respect to another surface.

This shape results from cutting off the rear end side of the tip of a wedge shape, namely the right-hand side of the upper end in FIG. 19, at the time of forming the connector 10. This is advantageous in that when the connector is formed by plastic molding, the connector gripping effort needed for its removal from the mold can be performed earlier.

It is also the result of consideration given to facilitate opening of a slit 15 with the tap screw 2*a* inserted into the screw insertion hole 16.

More specifically, in this embodiment, unlike the embodiment illustrated in FIGS. 15 and 16, the slit 15 is formed on the rear end side of the connector 10, as shown in FIGS. 19 and 21. Next, on the rear end side of the connector, the upper end of the slit 15 is not exposed to the upper surface of the tip side of the wedge shape, and the slit 15 is in communication with a lateral slit 15a formed on the rear end side of the connector 10, as shown in FIG. 20.

An outer end of the lateral slit 15*a* is open in a recess 13 formed in an outer side face 12 of the connector 10.

Thus, in the connector 10 of this embodiment, the tip portion of the wedge shape is thin-walled on the rear end side on the whole, so when the tap screw 2*a* is inserted into the screw insertion hole 16, the slit 15 can be forced to open more easily.

In this embodiment, however, unlike the embodiment illustrated in FIGS. 15 and 16, when the slit 15 is forced to open, the tip portion of the wedge shape is not opened but is swelled.

Also in the connector 10 of this embodiment, an insert portion 14 is formed integrally with a front end face of the connector. The insert portion 14 is formed in a columnar shape of a circular shape of a circular section although the insert portion 14 used in the embodiment illustrated in FIGS. 15 and 16 is of a cylindrical shape having an elliptic section.

Consequently, a hole of a circular section can be formed in the frame board 1 or the like and thus the hole making operation gets easier.

In the insert portion 14 used in this embodiment, a reduced-diameter portion 11*a* of a through-hole 11 is open in a position eccentric to the center of the insert portion.

In this embodiment, like the embodiment illustrated in FIGS. 15 and 16, when the connectors 10 according to this embodiment are disposed in a coaxially opposed relation to each other on both sides of the frame board 1, the respective screws 2 as fixing members dodge each other and thus the intercollision of the two is avoided.

Although the present invention has been described above with respect to the case where the connector 10 according to the invention is used for connecting the cross board 3 perpendicularly laterally to the frame board 1 which forms a vertical surface, it goes without saying that the connector is employable also for oblique connection such as connecting one end of a handrail to a wall to install a stair handrail structure.

According to the present invention, as set forth above, the connector of the invention is advantageous in its for connecting a cross board, a rod member, or the like, to a vertical surface or the like formed by a frame board, a wall or the like.

For example, in the case of forming a large-sized wardrobe or bookshelf having three or more frame boards which form vertical surfaces and which are arranged in parallel and also having cross boards as shelf boards arranged between adjacent such frame boards, the cross boards can be connected to the frame boards easily by a simple operation of merely fixing the connectors to predetermined positions with screws.

As a result, it becomes possible to provide large-sized wardrobes and bookshelves even according to the knock-down system requiring the users to assemble them. Also in the case of post-mounting a built-in type wardrobe or bookshelf according to a conventional method, it is possible to mount any desired built-in type wardrobe or bookshelf without requiring large expenses.

Further, in the case of post-mounting a stair handrail structure, one end of the handrail can be connected to a wall simply by forming a recess in the underside of the end portion of the handrail which is a bar member and then burying the connector attached to the wall surface into the recess. Thus, according to the present invention, in comparison with the conventional method, a desired stair handrail structure can be installed without the need of using any additional, auxiliary metal fittings or the like.

Also as to the formation of the connector, in the case where it is formed of a plastic material, e.g. polypropylene, all that is required at the beginning is only producing a mold, and the connector can be mass-produced inexpensively. Thus, also from the standpoint of supply, the connector of the invention is convenient and advantageous.

What is claimed is:

1. A surface connector for connecting adjacent surfaces of two objects, the connector comprising:

a contact side positionable against the adjacent surface of a first of the two objects;

said connector having means defining a through hole, said through hole having an opening in the connector for insertion of a fixing member into said though hole, though said contact side and into the adjacent surface of the first object;

a tip side extending away from said contact side;

a base side extending away from said contact side and substantially opposite said tip side, said base side having a substantially trapezoidal shape;

a cross sectional shape substantially parallel to said contact side, said cross sectional shape being substantially wedge-shaped from said tip side to said base side, said cross sectional shape being insertable tip side first into a receiving means on a second of the two objects bordering the adjacent surface of the second object;

anti-dislodgment means formed between said tip side and said base side, and extending away from said contact side, said anti-dislodgment means locking the second object to the connector when the connector is inserted into said receiving means of said second object.

2. A connector in accordance with claim 1, wherein:

said through hole is positioned eccentric to a longitudinal axis of the connector.

3. A connector in accordance with claim 1, wherein:

said anti-dislodgment means defines recesses positioned substantially opposite each other on the connector.

4. A connector in accordance with claim 1, wherein:

another cross section shape, substantially perpendicular to said contact side and extending from said tip side to said base side is substantially rectangular shaped.

5. A connector in accordance with claim 1, wherein:

another cross section shape, substantially perpendicular to said contact side and extending from said tip side to said base side, is substantially in a shape of a pentagon, with said tip side having a first surface inclined with respect to a second surface.

6. A connector in accordance with claim 1, further comprising:

a tenon means extending away from said contact side and for inserting into the adjacent face of the first object, said through hole extending through said tenon means.

7. A connector in accordance with claim 6, wherein:

said though hole is positioned eccentrically with respect to said tenon means.

8. A connector in accordance with claim 1, further comprising:

means for defining a slit on said tip side and for increasing a size of said tip side when a member is inserted into said slit.

* * * * *